US009534737B2

(12) United States Patent
Ringstein

(10) Patent No.: US 9,534,737 B2
(45) Date of Patent: Jan. 3, 2017

(54) FLUID TANK

(71) Applicant: Magna Powertrain AG & Co KG, Lannach (AT)

(72) Inventor: Markus Ringstein, Graz-Liebenau (AT)

(73) Assignee: MAGNA POWERTRAIN AG & CO KG, Lannach (AT)

( * ) Notice: Subject to any disclaimer, the term of this patent is extended or adjusted under 35 U.S.C. 154(b) by 0 days.

(21) Appl. No.: 14/806,752

(22) Filed: Jul. 23, 2015

(65) Prior Publication Data

US 2016/0025268 A1 Jan. 28, 2016

(30) Foreign Application Priority Data

Jul. 24, 2014 (DE) ..... 10 2014 214 574

(51) Int. Cl.
*F17C 3/00* (2006.01)
*F17C 13/00* (2006.01)
*F17C 13/06* (2006.01)

(52) U.S. Cl.
CPC ..... *F17C 13/005* (2013.01); *F17C 13/06* (2013.01)

(58) Field of Classification Search
CPC F17C 13/005; F17C 13/06; F01M 2011/0066; F01M 11/0458
USPC ..... 123/196 R
See application file for complete search history.

(56) References Cited

U.S. PATENT DOCUMENTS 4,724,833 A * 2/1988 Bartos ..... A62B 7/02 128/205.24
5,085,188 A * 2/1992 Gasparri ..... F01M 1/10 123/196 A
6,886,608 B2 * 5/2005 Jacob ..... G05D 9/02 141/113
2005/0039718 A1 2/2005 Tsutsumi et al.

FOREIGN PATENT DOCUMENTS

EP 1369556 A1 12/2003

* cited by examiner

*Primary Examiner* — Stephen Castellano
(74) *Attorney, Agent, or Firm* — Dickinson Wright PLLC

(57) ABSTRACT

A fluid tank for a motor vehicle comprising a housing, wherein the housing has a housing base, a housing cover and at least one side wall. A through-passage is formed inside the side wall, wherein the through-passage extends from a first opening in the housing base in the direction of the housing cover. The through-passage is in fluidic connection with the interior of the fluid tank via a second opening.

19 Claims, 3 Drawing Sheets

FLUID TANK

CROSS-REFERENCE TO RELATED APPLICATIONS

This application claims the benefit and priority of German Application No. 10 2014 214 574.0 filed Jul. 24, 2014. The entire disclosure of the above application is incorporated herein by reference.

TECHNICAL FIELD

The present disclosure relates to a fluid tank for a motor vehicle.

BACKGROUND

This section provides background information related to the present disclosure which is not necessarily prior art.

Fluid containers preferably function inside motor vehicles as oil reservoirs from which transmissions and engines, in particular, draw oil for lubrication and cooling. Within these applications, on the one hand, it is important to be able to adjust as accurately as possible the filling level of the oil and, on the other hand, easy drainage of the oil from the container and/or the oil pan is advantageous. In most cases, oil pans generally comprise an oil supply opening at the side or on the upper face and an oil drainage opening on the lower face. However, designs are also known from the prior art which have the oil drainage opening only on the lower face of the oil pan and which also use said oil drainage opening for filling the oil pan with oil.

EP 1 369 556 A1 discloses, for example, a design of a filling device for regulating the oil level in oil pans in engines and transmissions. The solution set forth therein discloses an oil pan with an opening in the base of the oil pan, said opening being able to be closed by an oil drain screw. An oil filling collar which protrudes into the interior of the oil pan is arranged above the opening in the base. A releasable filling pipe is attached to the oil filling collar, wherein the opening of the filling pipe constitutes an overflow opening which determines the defined oil level. By displacing the filling pipe relative to the oil filling collar into a position in which two recesses overlap, one on the filling pipe and one on the oil filling collar, oil is able to be drained out again. A drawback with the solution disclosed in EP 1 369 556 A1 is the costly two-part design.

SUMMARY

This section provides a general summary of the disclosure and is not intended to be a comprehensive disclosure of its full scope or all of its aspects, objectives and features.

It is an object of the present disclosure to improve fluid tanks for motor vehicles in this regard and, in particular, to disclose a one-piece, cost-effective and space-saving solution.

The object is achieved by a fluid tank for a motor vehicle comprising a housing, wherein the housing has a housing base, a housing cover and at least one side wall, wherein a through-passage is formed inside the side wall, wherein the through-passage extends from a first opening in the housing base in the direction of the housing cover, and wherein the through-passage is in fluidic connection with the interior of the fluid tank via a second opening.

The interior of the fluid tank is in fluidic connection with the exterior via a second opening, a through-passage and a first opening. The filling of the fluid tank, therefore, may preferably take place via the through-passage integrated in the housing, preferably in a side wall. No additional components are required.

The production of the housing may take place, for example, by a casting method or a deep-drawing method. The through-passage may be formed in one piece with the housing or retrospectively incorporated by the machining of the housing.

The extent of the through-passage in the direction of the housing cover preferably runs substantially perpendicular to the housing base but may also be inclined and/or curved.

Preferably, the second opening is located in the vicinity of the housing cover, wherein the housing cover forms a limit to the second opening. The dimensioning of the second opening may be adapted to the required fluid filling level in the fluid tank, whereby the fluid filling level is regulated via the second opening.

In one embodiment, the through-passage is in fluidic connection with the interior of the fluid tank via a third opening. The third opening is preferably located in the vicinity of the housing base, wherein the housing base forms a limit to the third opening. As a result, when it is desired to empty the fluid tank, the fluid is able to flow out at a point of the housing which is located at the bottom and the fluid tank is almost completely emptied of fluid.

In an advantageous embodiment of the invention, the through-passage has a tapered portion above the third opening in the direction of the housing cover.

In order to prevent undesired emptying, in normal operation, i.e. in the state filled with fluid, the fluid tank is configured such that in the region of the third opening the through-passage of the fluid tank has an annular sleeve around the periphery.

The annular sleeve is preferably configured from a polymer and is resiliently deformable.

In another embodiment, in the region of the first opening the through-passage has a receiver for a closure element, in particular a thread for a screw. By means of the closure element, the through-passage may be sealed toward the outside and during normal operation, i.e. in the state filled with fluid, the fluid may be prevented from inadvertently sloshing out. Additionally, in normal operation the fixed closure element deforms the annular, resilient sleeve counter to the tapered portion of the through-passage and ensures a sufficient seal of the third opening relative to the through-passage.

Preferably, a sealing element is arranged between the closure element and the housing, in particular the housing base, in order to prevent in addition the undesired outflow of fluid.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure. The invention is described hereinafter by way of example with reference to the drawings, in which.

DESCRIPTION

Example embodiments of a fluid tank for motor vehicles are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

Figure 1:
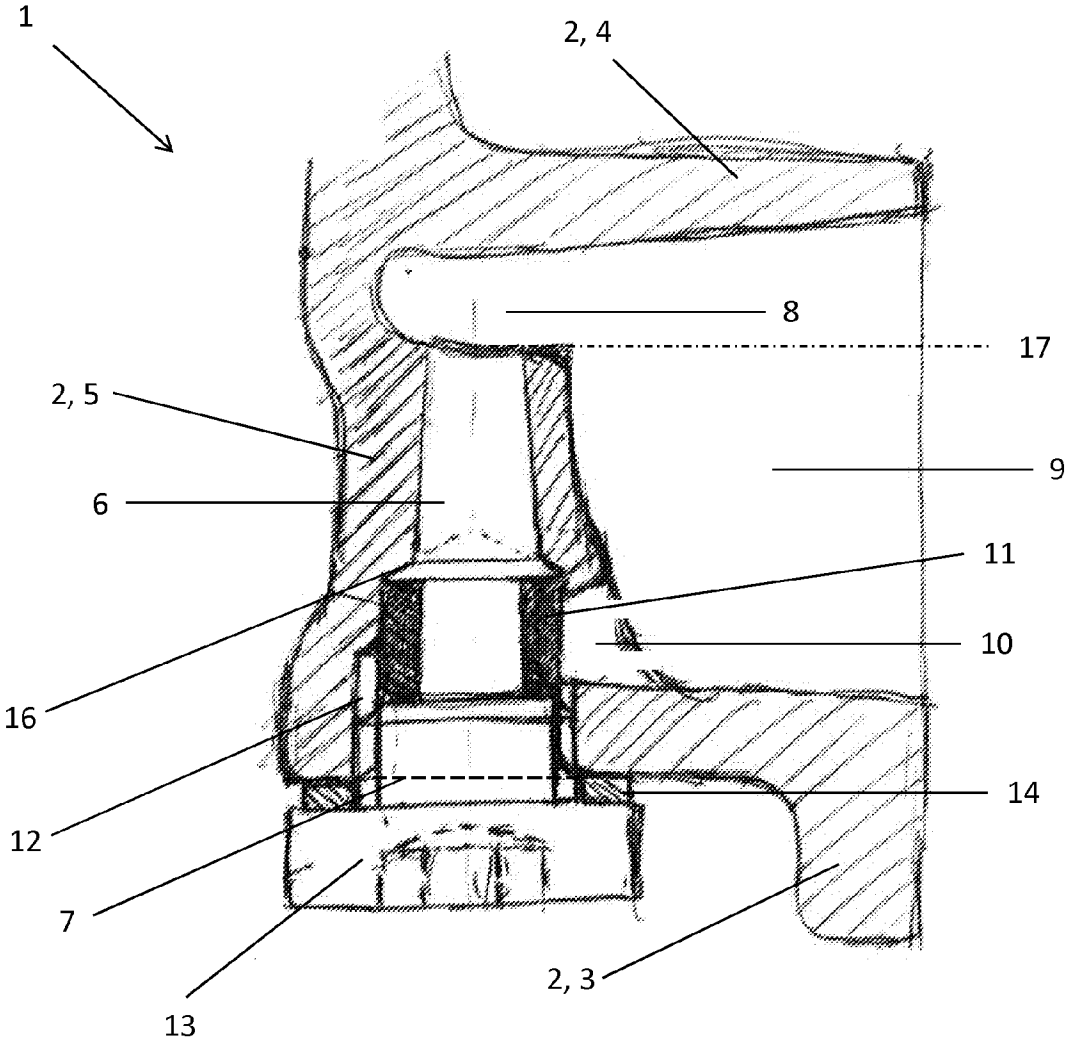
FIG. 1 shows a fragmented sectional view of the fluid tank according to the invention.

A fragmented sectional view of a fluid tank 1 according to the present disclosure is shown in FIG. 1. A housing 2 comprises a housing base 3, a housing cover 4, and at least one side wall 5. A through-passage 6 is formed inside the side wall 5. The through-passage 6 extends from a first opening 7 in the housing base 3 at least partially parallel to the side wall 5 in the direction of the housing cover 4 and is in fluidic connection with an interior 9 of the fluid tank 1 via a second opening 8. Thus the interior 9 of the fluid tank 1 is in fluidic connection with the exterior via the second opening 8, the through-passage 6 and the first opening 7.

Figure 2:
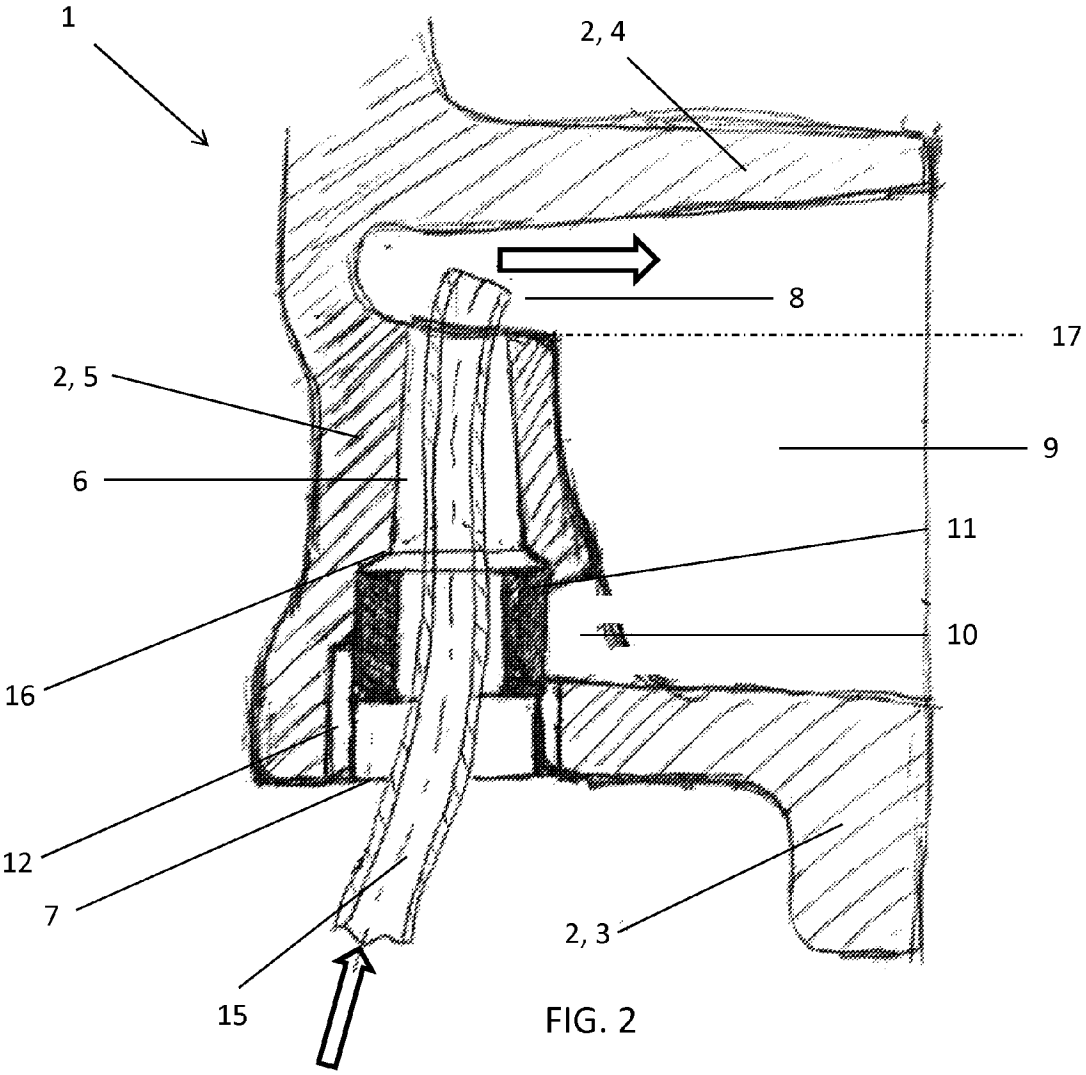
FIG. 2 shows a fragmented sectional view of the fluid tank according to the invention during the fluid filling process.

In the embodiment shown in FIG. 2, the second opening 8 is located in the vicinity of the housing cover 4, wherein the housing cover 4 forms a limit to the second opening 8. The closer the second opening 8 is configured to the housing cover 4, the higher a maximum possible fluid filling level 17 in the fluid tank 1.

The through-passage 6 is also in fluidic connection with the interior 9 of the fluid tank 1 via a third opening 10. The third opening is preferably located in the vicinity of the housing base 3, wherein the housing base 3 forms a limit to the third opening 10. The closer the third opening 10 is configured to the housing base 3, the more completely the fluid tank 1 is able to be emptied of fluid during the emptying process (see also FIG. 3).

The through-passage 6 has a tapered portion 16 above the third opening 10 in the direction of the housing cover 4.

In order to prevent undesired emptying, in normal operation, i.e. in the state filled with fluid, the fluid tank 1 is configured such that the through-passage 6 of the fluid tank 1 in the region of the third opening 10 has an annular sleeve 11 around the periphery. This annular sleeve 11 is formed from a polymer and is resilient.

The through-passage 6 has, in the region of the first opening 7, a receiver 12 for a closure element 13. By means of the closure element 13, the through-passage 6 may be closed toward the exterior and during normal operation, i.e. in the state filled with fluid, the fluid may be prevented from inadvertently sloshing out.

By means of the resilient design, the annular sleeve 11 in normal operation may be additionally pressed by the closure element 13 against a tapered portion 16 of the through-passage 6 and this ensures a sufficient seal of the third opening 10 relative to the through-passage 6.

A sealing element 14 is arranged between the closure element 13 and the housing 2, in particular the housing base 3.

Figure 3:
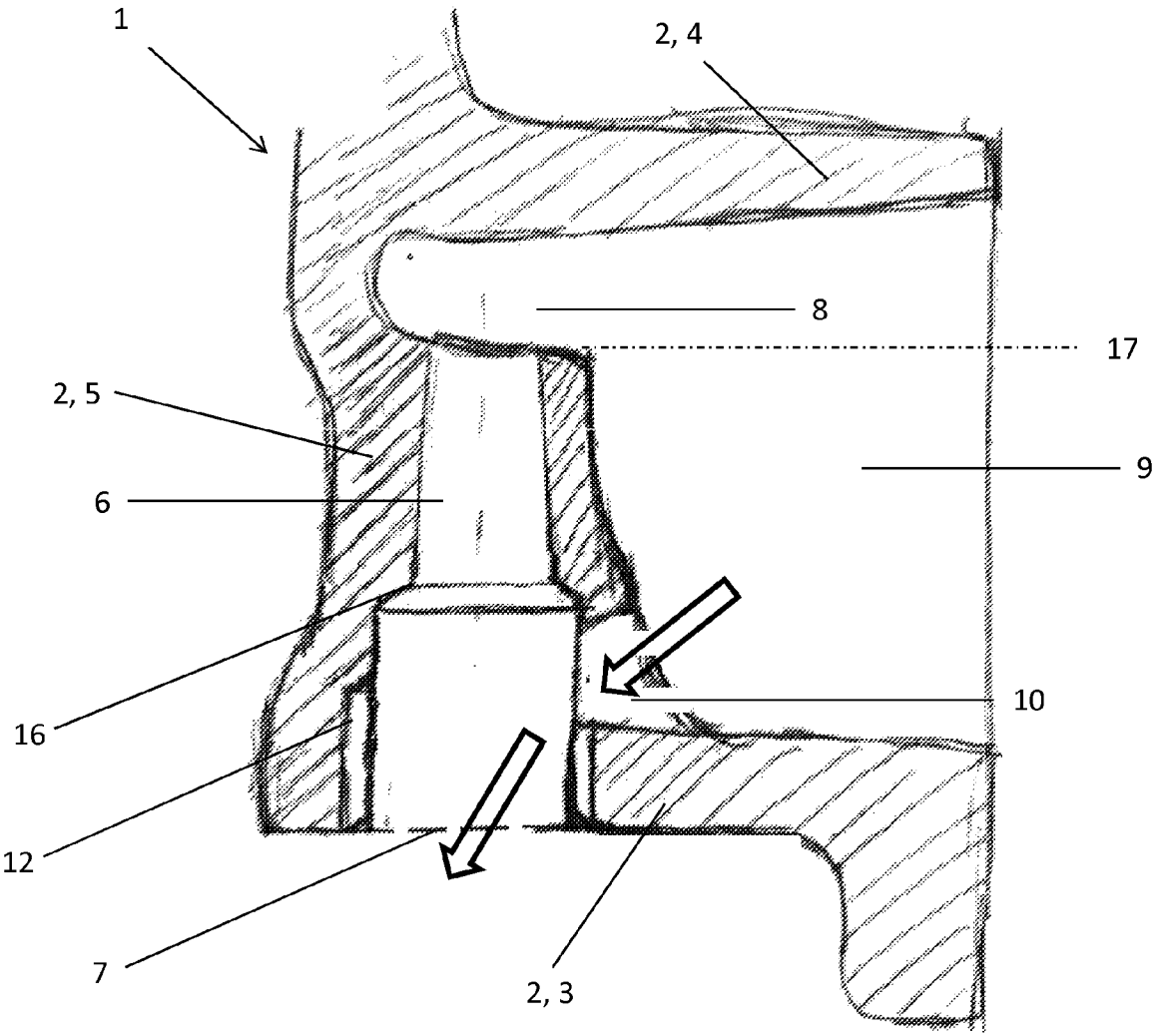
FIG. 3 shows a fragmented sectional view of the fluid tank according to the invention during the fluid emptying process.

FIG. 2 and FIG. 3 show a fragmented sectional view of the fluid tank according to the present disclosure during the fluid filling process (FIG. 2) and the fluid emptying process (FIG. 3). Elements which are the same and have the same function are provided in FIG. 2 and FIG. 3 with the same reference numerals as in FIG. 1, so that in this respect reference is made to the above description.

An auxiliary hose 15 which may be used to assist with filling the fluid tank 1 with fluid is shown in FIG. 2. The auxiliary hose 15 is guided via the first opening 7, the through-passage 6 and the second opening 8 into the interior 9 of the fluid tank 1. Via the auxiliary hose 15 fluid is filled into the interior 9 of the fluid tank 1 until the fluid flows out again from the interior 9 of the fluid tank 1 via the second opening 8, the through-passage 6 and the first opening 7—then the maximum fluid filling state 17 should be achieved.

The arrows in FIG. 2 describe schematically the path of fluid when the fluid tank 1 is filled.

In FIG. 3, the fluid emptying process is shown schematically. By removing the closure element 13 and the annular sleeve 11, the third opening 10 is opened up and connects the interior 9 of the fluid tank 1 to the through-passage 6. In this manner, fluid is able to flow out of the fluid tank 1 via the through-passage 6 and the first opening 7. The arrows in FIG. 3 describe schematically the path of the fluid when the fluid tank 1 is emptied.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

LIST OF REFERENCE SIGNS

1 Fluid tank
2 Housing
3 Housing base
4 Housing cover
5 Side wall
6 Through-passage
7 First opening
8 Second opening
9 Interior
10 Third opening
11 Annular sleeve
12 Receiver
13 Closure element
14 Sealing element
15 Auxiliary hose
16 Tapered portion
17 Maximum fluid filling level

The invention claimed is:

1. A fluid tank for a motor vehicle comprising a housing, wherein the housing has a housing base, a housing cover, and at least one side wall, wherein a through-passage is formed inside the side wall, wherein the through-passage extends from a first opening in the housing base in the direction of the housing cover, wherein the through-passage is in fluidic connection with the interior of the fluid tank via a second opening, wherein the through-passage is in fluidic connection with the interior of the fluid tank via a third opening and wherein the through-passage has a taper portion above the third opening in the direction of the housing cover, wherein the second opening is located in the vicinity of the housing cover.

2. The fluid tank according to claim 1, wherein the housing cover forms a limit to the second opening.

3. The fluid tank according to claim 1, wherein the third opening is located in the vicinity of the housing base.

4. The fluid tank according to claim 3, wherein the housing base forms a limit to the third opening.

5. The fluid tank according to claim 1, wherein in normal operation of the fluid tank in the region of the third opening the through-passage has an annular sleeve around the periphery.

6. The fluid tank according to claim 5, wherein the annular sleeve is configured from a polymer.

7. The fluid tank according to claim 5, wherein the annular sleeve is resiliently deformable.

8. The fluid tank according to claim 1, wherein in the region of the first opening the through-passage has a receiver for a closure element.

9. The fluid tank according to claim 8, wherein a sealing element is arranged between the closure element and the housing, in particular the housing base.

10. A fluid tank of a motor vehicle, comprising:

a housing defining an interior and an exterior of the fluid tank, the housing having a housing base, a housing cover, and at least one side wall;

a first opening formed in the housing base and leading to the exterior of the fluid tank;

a second opening formed in the vicinity of the housing cover, wherein the housing cover forms a limit to the second opening;

a third opening located in the vicinity of the housing base, wherein the housing base forms a limit to the third opening; and a through-passage formed within the at least one side wall of the housing and being substantially perpendicular to the housing base, the through-passage extending from the first opening in the housing base in the direction of the housing cover to the second opening, wherein the through-passage has a tapered portion above the third opening in the direction of the housing cover, wherein the through-passage is in fluidic connection with the interior of the fluid tank via the second opening and the third opening, and wherein the through-passage is in fluidic connection with the exterior of the fluid tank via the first opening.

11. The fluid tank of claim 10, wherein the first opening has a receiver and the third opening has an annular sleeve located around the periphery thereof and being resiliently deformable.

12. The fluid tank of claim 11, further comprising:

a closure element received by the receiver for sealing the through-passage from the outside to prevent fluid from inadvertently sloshing out during normal operation.

13. The fluid tank of claim 12, wherein the closure element is a screw.

14. The fluid tank of claim 12, wherein the closure element deforms the annular sleeve counter to the taper portion of the through-passage and ensures a seal of the third opening relative to the through-passage.

15. The fluid tank of claim 12, further comprising:

a sealing element arranged between the closure element and the housing base for preventing undesired outflow of fluid.

16. The fluid tank of claim 12, wherein the third opening connects the interior of the fluid tank to the first opening through the through-passage, such that fluid flows out of the first opening to the exterior of the fluid tank, when the closure element and the annular sleeve are removed.

17. A fluid tank for a motor vehicle, comprising:

a housing defining an interior and an exterior of the fluid tank, the housing having a housing base, a housing cover, and at least one side wall;

a first opening formed in the housing base and leading to the exterior of the fluid tank;

a second opening formed in the vicinity of the housing cover, wherein the housing cover forms a limit to the second opening;

a third opening located in the vicinity of the housing base, wherein the housing base forms a limit to the third opening; and a through-passage formed within the at least one side wall of the housing and being substantially perpendicular to the housing base, the through-passage extending from the first opening in the housing base in the direction of the housing cover to the second opening, wherein the through-passage has a tapered portion above the third opening in the direction of the housing cover, wherein the through-passage is in fluidic connection with the interior of the fluid tank via the second opening and the third opening, and wherein the through-passage is in fluidic connection with the exterior of the fluid tank via the first opening, and wherein the fluid tank is filled with fluid through the second opening and wherein the fluid tank is emptied through the third opening.

18. The fluid tank of claim 17, further comprising:

an auxiliary hose for assisting with filling the fluid tank with fluid and being guided via the first opening, the through-passage, and the second opening into the interior of the fluid tank.

19. The fluid tank of claim 17, wherein the location of the second opening indicates the maximum fluid filling state of the interior of the fluid tank.

* * * * *